US007665894B2

(12) United States Patent
DeBlander et al.

(10) Patent No.: US 7,665,894 B2
(45) Date of Patent: Feb. 23, 2010

(54) FLEXIBLE BAG HAVING A HANDLE WHICH FACILITATES HANGING FROM A PLURALITY OF DIFFERENT OUTSIDE STRUCTURES

(75) Inventors: Darin DeBlander, Wheaton, IL (US); Raul Z. Gonzales, Northlake, IL (US); James Rooney, Naperville, IL (US); Ken Wehling, Franklin Park, IL (US)

(73) Assignee: Scholle Corporation, Irvine, CA (US)

( * ) Notice: Subject to any disclaimer, the term of this patent is extended or adjusted under 35 U.S.C. 154(b) by 440 days.

(21) Appl. No.: 11/235,676

(22) Filed: Sep. 26, 2005

(65) Prior Publication Data

US 2007/0071363 A1 Mar. 29, 2007

(51) Int. Cl.
*B65D 33/10* (2006.01)

(52) U.S. Cl. ..... 383/9; 383/7; 383/10

(58) Field of Classification Search ..... 383/9, 383/66, 24, 26, 10, 7, 8; 493/226; 53/413; 221/283

See application file for complete search history.

(56) References Cited

U.S. PATENT DOCUMENTS

| | | | | |
|---|---|---|---|---|
| 2,838,046 | A | 6/1958 | Butler | |
| 3,339,825 | A * | 9/1967 | Grevich | 383/9 |
| 3,924,781 | A | 12/1975 | Witte | |
| 3,930,286 | A | 1/1976 | McGowen | |
| 4,482,585 | A | 11/1984 | Ohodira et al. | |
| 4,484,351 | A * | 11/1984 | de Leeuwe et al. | 383/9 |
| 4,601,410 | A | 7/1986 | Bond | |
| 4,636,412 | A * | 1/1987 | Field | 604/408 |
| 4,657,540 | A | 4/1987 | Iwamoto et al. | |
| 4,778,699 | A | 10/1988 | Knox, III et al. | |
| 4,910,147 | A | 3/1990 | Bacehowski et al. | |
| 4,998,990 | A | 3/1991 | Richter et al. | |
| 5,033,868 | A * | 7/1991 | Peppiatt | 383/29 |
| 5,104,235 | A * | 4/1992 | Bronstrup et al. | 383/10 |
| 5,195,987 | A | 3/1993 | Karpiak | |

(Continued)

FOREIGN PATENT DOCUMENTS

| | | |
|---|---|---|
| GB | 2111944 | 6/1983 |

(Continued)

*Primary Examiner*—Nathan J Newhouse
*Assistant Examiner*—Jack H Morgan, Jr.
(74) *Attorney, Agent, or Firm*—Jovan N. Jovanovic; Vladan M. Vasiljevic; The Watson I.P. Group, PLC.

(57) ABSTRACT

A flexible bag comprising an outer panel assembly, a cavity sealing assembly, a spout assembly, and a handle area. The outer panel assembly comprises a first panel and a second panel positioned in an overlaying orientation. The cavity sealing assembly includes opposing side seals, a top cavity seal and a bottom cavity seal which cooperate to form a cavity. Two extension regions extend away from the top cavity seal. The spout assembly is attached to the first panel and provides fluid communication with the cavity. The handle area includes a top handle seal spaced apart from the top cavity seal and the first and second extension regions. The first extension region in cooperation with the top handle seal defines a first side opening slot, and, the second extension region in cooperation with the top handle seal defines a second side opening slot. A hanging opening extends through the first panel and the second panel between the top cavity seal and the top handle seal.

16 Claims, 4 Drawing Sheets

U.S. PATENT DOCUMENTS 5,259,844 A 11/1993 Bilstad et al.
5,307,955 A 5/1994 Viegas
5,334,180 A * 8/1994 Adolf et al. ..... 604/411
5,514,106 A 5/1996 D'Silva
5,647,511 A 7/1997 Bond
5,690,253 A 11/1997 LaFleur
5,743,435 A 4/1998 Tomic
5,749,493 A 5/1998 Boone et al.
5,749,657 A * 5/1998 May ..... 383/9
5,827,164 A 10/1998 Tomic
5,910,138 A 6/1999 Sperko et al.
5,941,866 A 8/1999 Niedospial, Jr.
6,200,300 B1 3/2001 Petriekis et al.

FOREIGN PATENT DOCUMENTS

JP 02255147 10/1990

* cited by examiner

FLEXIBLE BAG HAVING A HANDLE WHICH FACILITATES HANGING FROM A PLURALITY OF DIFFERENT OUTSIDE STRUCTURES

BACKGROUND OF THE INVENTION

1. Field of the Invention

The present invention relates to a flexible bag, and more particularly, to a flexible bag having multiple hanging modes. Specifically, the bag can be hung from a number of different outside structures, while minimizing interference from the different flexible bag components.

2. Background Art

The use of flexible bags has increased steadily over the past few decades. New uses for flexible bags is constantly being developed. One such development has been with the use of flexible bags which can be suspended or hung from outside structures, then emptied through a spout provided on the flexible bag. One such configuration is shown in U.S. Pat. No. 6,200,300 issued to Petriekis et al (the '300 patent).

The '300 patent discloses a hangable bag which includes a plurality of openings which are extended through an opening of a relatively wide seal area. Such a construction is not without drawbacks. First, the openings are directed through a seal structure which increases the chances of zippering of the material proximate the hanging openings. Second, the structure of the '300 patent permits only one manner of hanging, namely by hooks through the openings in the larger seals. Thus, the utility is quite limited.

Another hangable flexible bag is shown in Australian Design Registration 143,022 issued to Scholle. This design model provides both openings through which hooks can be attached and a lateral slot through which a rod can be drawn. While such a flexible bag provides for enhanced utility, the size of the openings are relatively small, but larger openings would hamper the transverse insertion of the rod. Moreover, the small, circular configuration of the openings is quite limiting.

It is an object of the present invention to provide for a flexible bag that has multiple modes of attachment to outside surfaces, such as, for example, suspension from a plurality of hooks and/or suspension from a transverse rod, with an improved construction.

It is another object of the invention to minimize interference between the openings for suspension by hooks and the structure through which suspension by way of a transverse rod can be achieved.

These and other objects of the invention will become apparent in light of the specification and claims appended hereto.

SUMMARY OF THE INVENTION

The invention comprises a flexible bag having an outer panel assembly, a cavity sealing assembly, a spout assembly and a handle area. The outer panel assembly comprises a first panel and a second panel positioned in an overlaying orientation. The cavity sealing assembly comprises a first side seal and a second side seal opposing the first side seal, a top cavity seal spanning between the first and second side seals, a first extension region extending away from the top cavity seal and a second extension region extending away from the top cavity seal. The first extension region is positioned proximate the first side seal and the second extension region is positioned proximate the second side seal. Finally, a bottom cavity seal spans between the first and second side seals, spaced apart from the top cavity seal a distance, to, in turn, define a cavity for a flowable material. The spout assembly is attached to the first panel, the spout providing fluid communication with the cavity. The handle area is positioned outside of the cavity and includes a top handle seal spaced apart from the top cavity seal and the first and second extension regions and at least one hanging opening. The first extension region in cooperation with the top handle seal defines a first side opening slot, and, the second extension region in cooperation with the top handle seal defines a second side opening slot. The hanging opening extends through the first panel and the second panel between the top cavity seal and the top handle seal.

In a preferred embodiment, the first extension region is integrated with the first side seal and the second extension region is integrated with the second side seal.

In another preferred embodiment, the first side seal, the second side seal the top cavity seal and the bottom cavity seal define a substantially rectangular configuration.

In another preferred embodiment, the top cavity seal and the top handle seal are substantially parallel to each other. The first and second extension regions are substantially perpendicular thereto.

In another preferred embodiment, the first and second extension regions are connected to the top cavity seal.

In yet another preferred embodiment, a bottom handle seal is positioned between the top cavity seal and the top handle seal, in closer proximity to the top cavity seal.

Preferably, in such an embodiment, the first side seal and the second side seal intersect the bottom handle seal.

In a preferred embodiment, the extension regions terminate a distance from the top cavity seal which is greater than the distance the at least one hanging opening is spaced apart from the top cavity seal.

In a preferred embodiment, the at least one hanging opening comprises two spaced apart hanging openings. The extension regions terminate a distance from the top cavity seal which is greater than the distance the at least one hanging opening is spaced apart from the top cavity seal.

In one such configuration, each of the hanging openings has an upwardly concave configuration. Preferably, each of the hanging openings has a central region and two opposing end regions each having a radius of curvature. The radius of curvature of the central region is greater than the radius of curvature of each of the two opposing end regions.

In another preferred embodiment, a first of the two spaced apart hanging openings is spaced apart from the top cavity seal a first distance. A second of the two spaced apart hanging openings is spaced apart from the top cavity seal a second distance. In this embodiment, the first and second distances are different.

In a preferred embodiment, the spout assembly includes a base flange and a body extending from the base flange.

In another preferred embodiment, each of the first and second panels comprise multiple plies. In one embodiment, each of the multiple plies comprises one of a co-extrusion and a laminate.

In another aspect of the invention, the invention comprises a flexible bag comprising an outer panel assembly, a cavity sealing assembly, a spout assembly and a handle area. The outer panel assembly comprises a first panel and a second panel positioned in an overlaying orientation. The cavity sealing assembly comprises a first side seal and a second side seal opposing the first side seal, a top cavity seal spanning between the first and second side seals, a first extension region extending away from the top cavity seal and a second extension region extending away from the top cavity seal. The first extension region is positioned proximate the first side seal and the second extension region is positioned proximate the second side seal. Finally, a bottom cavity seal spans between the first and second side seals, spaced apart from the top cavity seal a distance, to, in turn, define a cavity for a flowable material. The spout assembly is attached to the first panel, the spout providing fluid communication with the cavity. The handle area is positioned outside of the cavity and includes a top handle seal spaced apart from the top cavity seal and the first and second extension regions and at least one hanging opening. The first extension region in cooperation with the top handle seal defines a first side opening slot, and, the second extension region in cooperation with the top handle seal defines a second side opening slot. The hanging opening comprises an upwardly concave configuration positioned closer to the top cavity seal than the respective ends of the first and second extension regions.

In one preferred embodiment, the first and second extension regions are integrated with the first side seal and the second side seal.

In one such embodiment, the invention further includes a bottom handle seal which is spaced apart from the top cavity seal and which intersects each of the first and second extension regions. Preferably, the top cavity seal, the bottom handle seal and the top handle seal are substantially parallel to each other, and the extension regions are substantially perpendicular thereto. Additionally, the bottom cavity seal is substantially parallel to the top cavity seal.

BRIEF DESCRIPTION OF THE DRAWINGS

The invention will now be described with reference to the drawings wherein.

DETAILED DESCRIPTION OF THE INVENTION

Figure 1:
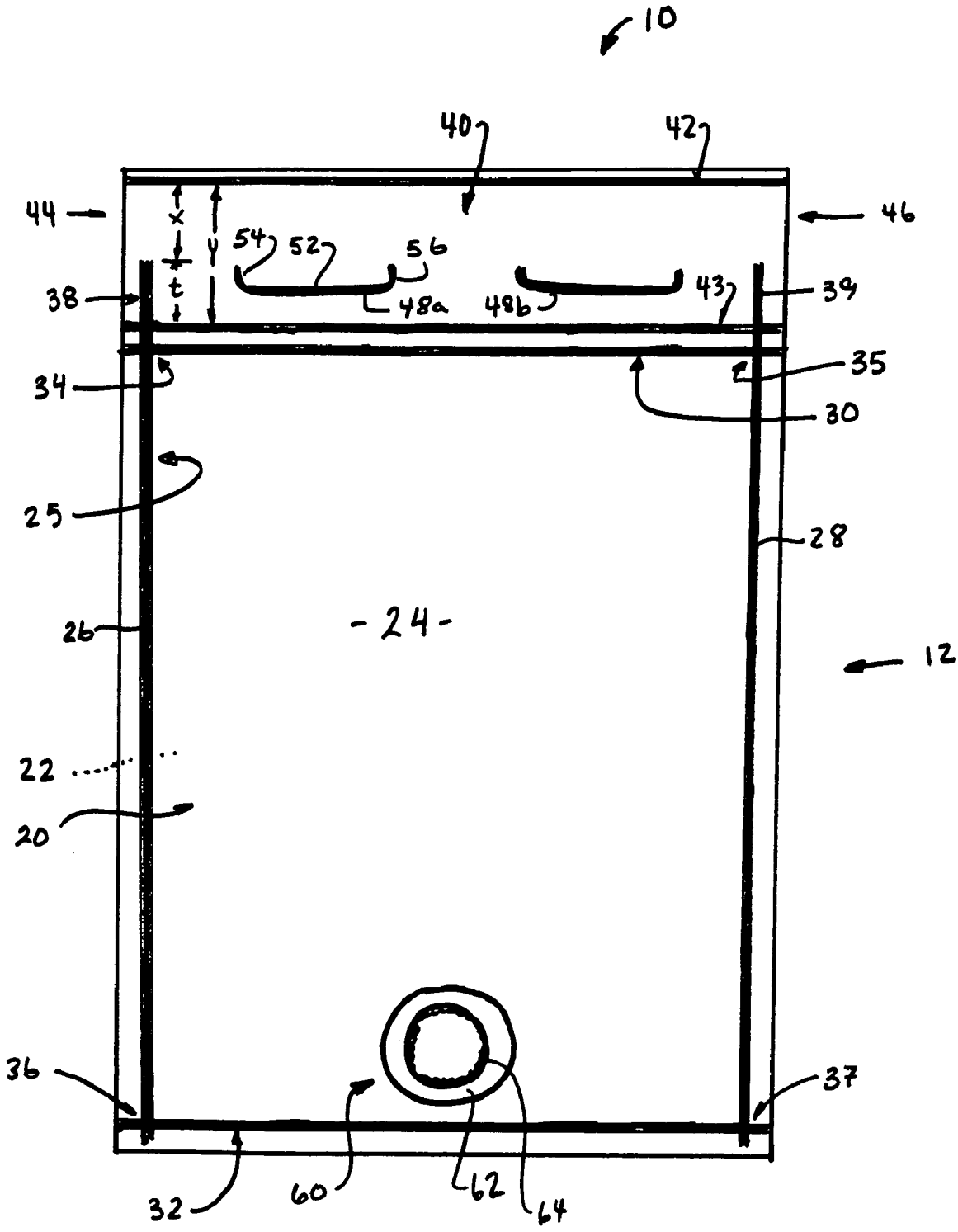
FIG. 1 of the drawings comprises a front elevational view of an embodiment of the hanging bag of the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the hanging bag is shown generally at 10. Specifically, the hanging bag includes outer panel assembly 12, cavity seal assembly 25, handle area 40 and spout assembly 60. As will be explained, hanging bag 10 is configured for releasable coupling to a number of outside structures. The hanging bag is fillable with, predominantly, a flowable material such as cleaning fluids, syrups, food products, among others. The hanging bag is not limited to use in association with any particular type of flowable material. In addition, it is contemplated that other types of materials may be contained within the flexible bag.

With reference to FIG. 1, outer panel assembly 12 includes front panel 20 and back panel 22. The panels are substantially identical in size and are placed in an overlying orientation. In the embodiment shown, the panels comprise two separate panels, however it is contemplated that the outer panel assembly may be formed from a single integrated panel that is folded into an overlying configuration. It will be understood that in such a configuration, one of the edges includes a fold or crease. It is contemplated that the panels may comprise a laminate or a co-extrusion. In other embodiments, the panels may comprise a single layer material. In still other configurations, the panels may include multiple plies that are generally separate members attached to each other proximate the heat seals. Indeed, in the contemplated embodiment, each of panel 20 and panel 22 comprise two plies wherein each ply comprises a co-extruded construction.

Referring again to FIG. 1, cavity seal assembly 25 includes opposing side seals 26, 28, top cavity seal 30, bottom seal 32. The seals intersect each other so as to define cavity 24. In the embodiment shown, seals 26, 28 are spaced apart from each other and substantially parallel to each other. Similarly, top cavity seal 30 and bottom seal 32 are spaced apart from each other and substantially parallel to each other. Specifically, top cavity seal 30 intersects with side seal 26 at intersection 34. Top cavity seal 30 intersects with side seal 28 at intersection 35. Bottom seal 32 intersects with side seal 26 at intersection 36. Bottom seal 32 intersects with side seal 28 at intersection 37. As such, the four seals substantially define a substantially rectangular cavity. In other embodiments, the seals may be positioned at angles relative to each other so as to define other structures. Additional seals may be provided (such as angled seals between the respective side seals and the bottom seal to enhance flow to spout assembly 60), as applications warrant. The seals are generally uniform in width and are approximately between 2 mm and 7 mm in width, and most preferably about 4.7 mm (approximately 3/16").

Figure 6A:
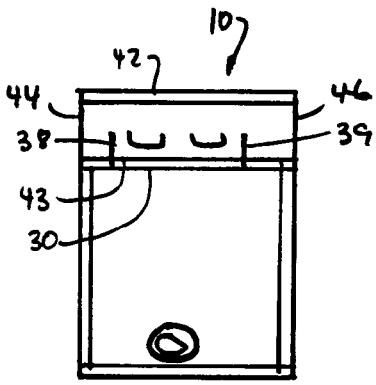
FIGS. 6*a* through 6*c* show a number of different configurations of the extension regions of the flexible bag of the present invention.
Figure 6B:
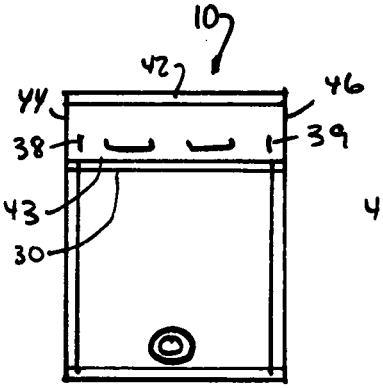
Figure 6C:
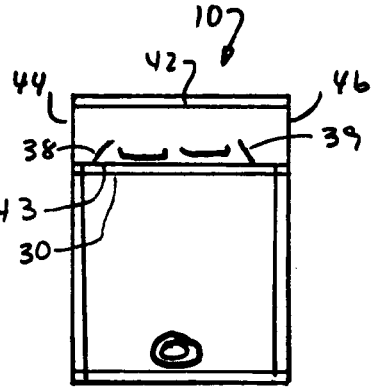

The two side seals 26, 28 extend beyond intersection 34 and 35 respectively into handle assembly 40, to define extension region 38 and extension region 39. The two extension regions extend into the handle assembly at least a distance of approximately 1 inch. The distance of extension is related to a number of factors, including, the size of the transverse structure to which the hanging bag may be coupled, the position of the openings that receive the hooks to which the hanging bag may be coupled and the overall width of the handle assembly. As is shown in FIGS. 6*a* through 6*c*, the extension regions may be separated form the side seals as well as the top cavity seal 30 and bottom handle seal 43. The extension regions provide a means for protecting those seals as well as the opening slots 44, 46.

Handle assembly 40 is shown in detail in FIG. 1 as comprising top handle seal 42, bottom handle seal 43, first side opening slot 44, second side opening slot 46 and hanging openings 48*a*, 48*b*. Handle area 40 is formed from the front panel and the back panel that extends beyond top cavity seal 30, and integral therewith. As such, in the embodiment shown, the handle area is formed from a front panel and a back panel, each of which includes two separate plies of material.

Bottom handle seal 43 is spaced apart from top cavity seal 30. In the embodiment shown, the top cavity seal 30 and the bottom handle seal 43 are spaced apart a relatively small distance and substantially parallel to each other. In the embodiment shown, the bottom handle seal intersects with each of the opposing side seals 26, 28 through the extension regions 38, 39, respectively. The position of the bottom handle seal has at least two purposes. First, the bottom handle seal protects the top cavity seal from punctures that may occur as a user attempts to insert a rod or other structure through the two side opening slots. Second, the bottom seal provides a second redundancy to the top cavity seal in the event that the top cavity seal is split or otherwise compromised.

Top handle seal 42 is spaced apart from the bottom handle seal 43 a distance beyond the end of the extension regions 38, 39. In turn, top handle seal 42 together with extension region 38 defines first side opening slot 44. Top handle seal 42 together with extension region 39 defines second side opening slot 46. In the embodiment shown, the top handle seal 42 is substantially parallel to the top cavity seal 30. It is desirable that the top handle seal is configured such that when a rod or other structure is extended through the two side opening slots, the weight of the flexible bag (filled with flowable material) is spread substantially uniformly across the seal to the extent possible.

The two side opening slots 44,46 are dimensioned such that they have a height, x, which is typically greater than the height of the extension regions 38, 39, namely height, t, and which is less than the distance between the top and bottom handle seals 42, 43, namely height, y. Moreover, in the embodiment shown, the outer ends of the top handle seal extends outboard of the extension regions 38, 39. In other embodiments, the top handle seal is shorter and ends inboard of the extension regions 38, 39. In a configuration wherein the end of the top handle seal and the extension regions are offset, introduction of the rod or other structure through the slots is greatly facilitated. In the embodiment shown, the extension regions are integral with the side seals and extend from the top cavity seal. As explained above, and, as is shown in FIGS. 6*a* through 6*c*, the extension regions may be separated from the cavity seals and/or separate from the side seals. In one embodiment, height y may be approximately 4 inches, height t is approximately 1 inch and height x is approximately 3 inches. Of course, other configurations and dimensions are likewise contemplated.

Hanging openings 48*a*, 48*b* extend through the front and back panels, respectively, so as to permit the insertion of a hook or other structure therethrough. Hanging opening 48*a* will be described with the understanding that hanging opening 48*b* is substantially identical. Hanging opening 48*a* comprises a substantially upwardly concave slit that extends through both panels. In the embodiment shown, the upwardly concave slit has a central region 52 and opposing end regions 54, 56. The central region has a first radius of curvature and the opposing end regions 54, 56 have a second radius of curvature. The first radius of curvature is substantially greater than that of the second radius of curvature. In such a configuration, the arcuate configuration of the upwardly concave slit includes a hook receiving region corresponding to the central region. The opposing end regions have a smaller radius of curvature such that they turn in an upward direction at a rate greater than that of the central region. In such a configuration, rip initiation and propagation is minimized. Moreover, any zippering that may occur inadvertently quickly reaches the top handle seal, wherein the top handle seal resists tearing. In other embodiments, the hanging openings may comprise a substantially linear central region and linear opposing end regions which intersect the linear central region at a predetermined angle which is preferably greater than 90° (although not limited thereto).

Figure 3:
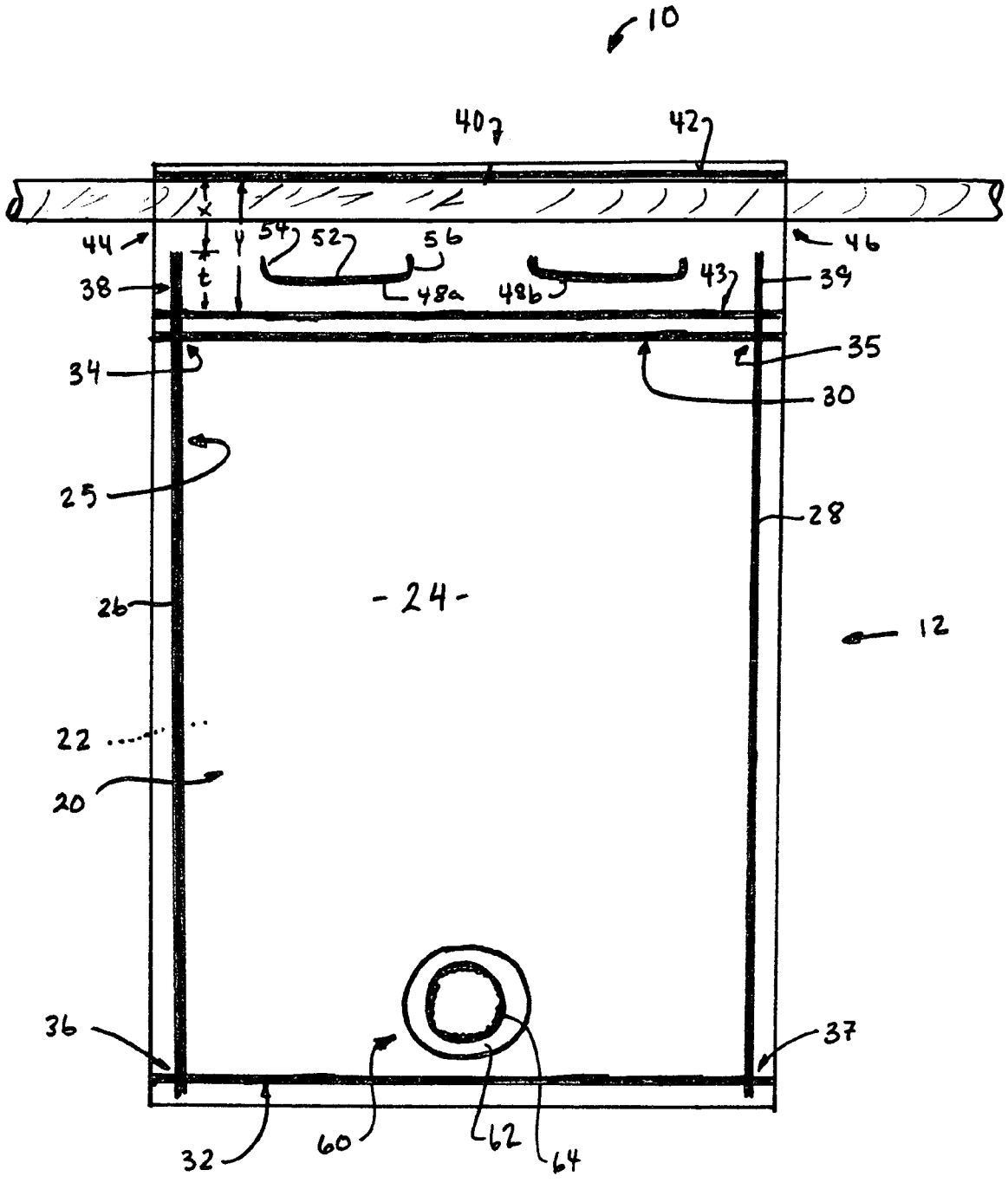
FIG. 3 of the drawings comprises a front elevational view of an embodiment of the hanging bag of the present invention, showing, in particular, a rod member extending through side opening slots.

Additionally, it is preferred that virtually the entirety of each of the hanging openings are positioned such that the extension regions 38, 39 extend beyond same. In such a configuration, and with reference to FIG. 3, the extension regions form a means by which to guide the rod member or other elongated structures beyond the hanging openings, and a means to protect the hanging openings from the rod member. Furthermore, these openings provide a means for protecting top cavity seal 30 and bottom handle seal 43. Indeed, the rod is generally maintained proximate the top handle seal 42 and away from the openings.

Figure 5:
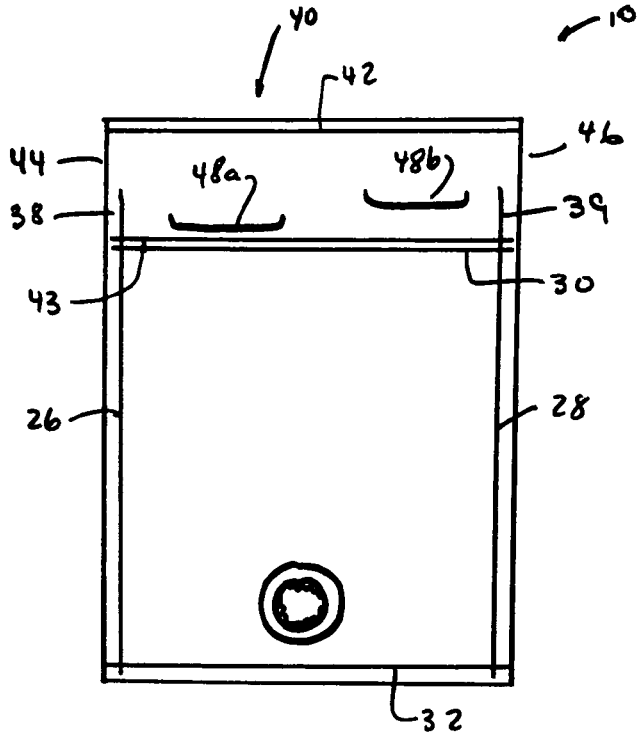
FIG. 5 of the drawings comprises a front elevational view of an embodiment of the hanging bag of the present invention, showing, in particular, the hanging openings of the handle area, wherein the openings are vertically offset.

In the embodiment shown, hanging opening 48*b* is substantially identical to hanging opening 48*a*. In other embodiments, the two hanging openings can be different. Or positioned at different locations. For example, and with reference to FIG. 5, the openings may be spaced apart a different distance from the top cavity seal 30. Correspondingly, the hooks or other structures may be vertically offset in a corresponding fashion. As such, when the flexible bag is positioned in a proper orientation, the top cavity seal is substantially horizontal, and the spout is positioned on the outward panel. On the other hand, if the flexible bag is incorrectly positioned, it will be immediately apparent that the top cavity seal is skewed (as is the remainder of the container), and the container position is incorrect.

Figure 2:
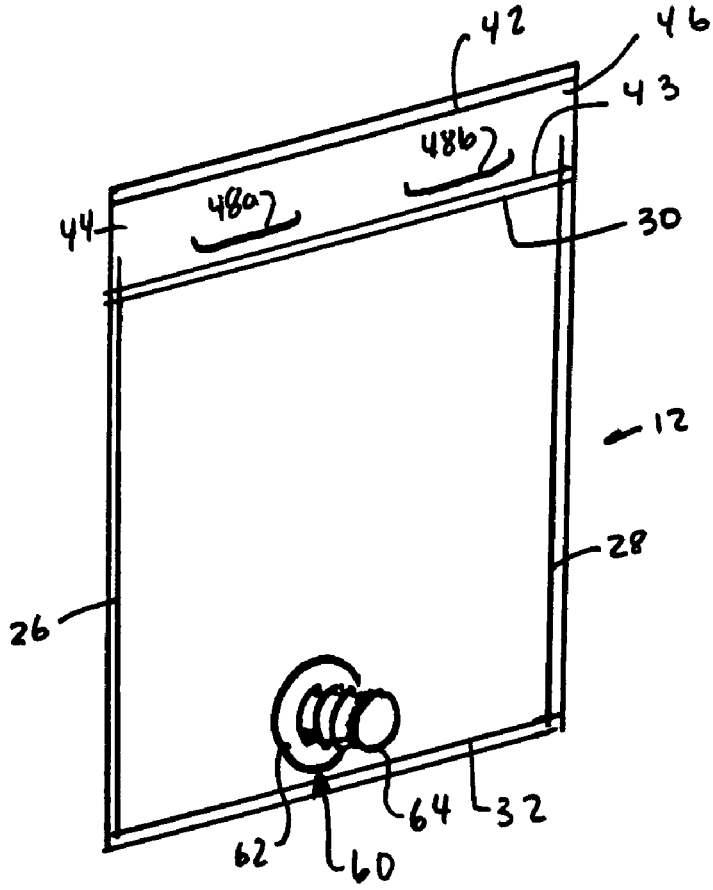
FIG. 2 of the drawings comprises a perspective view of an embodiment of the hanging bag of the present invention.

Spout assembly 60 is shown in FIGS. 1 and 2 as comprising flange 62 and spout body 64. Flange 62 is heat sealed to the front panel 20. Spout body 64 extends from flange 62. In certain embodiments, a number of flanges may be positioned along the outside surface of spout body 64. It is contemplated that any one of a number of different fitments may be coupled to the spouts (caps, covers, taps, etc.). In the embodiment shown, the spout is positioned between the opposing side seals 26, 28 and close to bottom seal 32. In one embodiment, an evacuation facilitating member may be coupled to or associated with the spout assembly (not shown). One such evacuation facilitating member is shown in U.S. Pat. No. 5,749,493 issued to Boone et al. Another such evacuation facilitating member is shown in U.S. Pat. No. 4,138,036 issued to Bond. The entire specification of each patent is incorporated by reference in its entirety. Of course, the evacuation facilitating member is not limited to the foregoing, and the foregoing are taken as being solely exemplary.

In operation, a user first obtains a flexible bag of the present invention filled with the desired material. It will be understood that the flexible bag may be formed and filled in any number of different processes. Moreover, the invention is not limited to any particular method of manufacturing.

Once the full flexible bag is provided to the user, the user has a number of different options or manners in which to hang the flexible bag. First, and with reference to FIG. 3, the user can pass a rod or other elongated member through each of the first and second side opening slots. In this manner, the rod is positioned between the two panels and supported at the upper end by the top handle seal. In other embodiments, opposing rods or elongated members can be inserted into opposing slots. The extension regions 38, 39 facilitate the maintaining of the rod member away from the bottom handle seal, the top cavity seal and the hanging openings.

Figure 4:
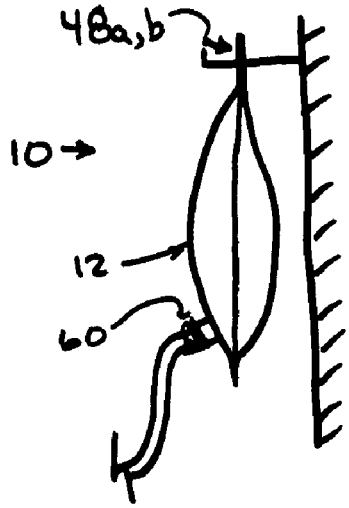
FIG. 4 of the drawings comprises a side elevational view of an embodiment of the hanging bag of the present invention, showing, in particular, a pair of hooks extending through the hanging openings of the handle area.

In another arrangement, instead of a rod member passing through the slots and between the panels of the handle area, hooks or the like may be extended through the hanging openings. For example, and with reference to FIG. 4, a plurality of hooks can be extended individually through the hanging openings. In the embodiment shown, the hooks may be identical and may be positioned side by side. In another embodiment, the hooks may be vertically offset, such that a corresponding flexible bag can only be positioned in one of a possible two orientations.

Advantageously, the hanging bag of the present invention allows for a single flexible bag to be utilized in a number of different orientations. In turn, a single product can be utilized by a number of different consumers in a plurality of manners. As such, the production of containers can be simplified to a single unified design.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A flexible bag comprising:

an outer panel assembly comprising a first panel and a second panel positioned in an overlaying orientation;

a cavity sealing assembly comprising:

a first side seal and a second side seal opposing the first side seal;

a top cavity seal spanning between the first and second side seals;

the first side seal further including a first extension region extending away from the top cavity seal and the second side seal further including a second extension region extending away from the top cavity seal, the first extension region positioned proximate the first side seal and the second extension region positioned proximate the second side seal; and a bottom cavity seal spanning between the first and second side seals, spaced apart from the top cavity seal a distance, to, in turn, define a cavity for a flowable material;

a spout assembly attached to the first panel, the spout providing fluid communication with the cavity;

a handle area outside of the cavity, the handle area including:

a top handle seal spaced apart from the top cavity seal and the first and second extension regions, the first extension region in cooperation with the top handle seal defines a first side opening slot having a width and, the second extension region in cooperation with the top handle seal defines a second side opening slot having a width, wherein a width in a region between the first side opening slot and the second side opening slot is larger than the respective width of each of the first and second side opening slots;

at least one hanging opening extending through the first panel and the second panel positioned between the top cavity seal and the top handle seal, and spaced apart from any seal, wherein the extension regions terminate a distance from the top cavity seal which is greater than the distance the at least one hanging opening is spaced apart from the top cavity seal.

2. The flexible bag of claim 1 wherein the first side seal, the second side seal, the top cavity seal and the bottom cavity seal define a substantially rectangular configuration.

3. The flexible bag of claim 1 wherein the top cavity seal and the top handle seal are substantially parallel to each other, and wherein the first and second extension regions are substantially perpendicular thereto.

4. The flexible bag of claim 1 wherein each of the first and second panels comprise multiple plies.

5. The flexible bag of claim 1 further comprising a bottom handle seal positioned between the top cavity seal and the top handle seal, in closer proximity to the top cavity seal.

6. The flexible bag of claim 5 wherein the first side seal and the second side seal intersect the bottom handle seal.

7. The flexible bag of claim 1 wherein the at least one hanging opening comprises two spaced apart hanging openings, and wherein the extension regions terminate a distance from the top cavity seal which is greater than the distance the at least one hanging opening is spaced apart from the top cavity seal.

8. The flexible bag of claim 7 wherein a first of the two spaced apart hanging openings is spaced apart from the top cavity seal a first distance, a second of the two spaced apart hanging openings is spaced apart from the top cavity seal a second distance, wherein the first and second distances are different.

9. The flexible bag of claim 7 wherein each of the hanging openings has an upwardly concave configuration.

10. The flexible bag of claim 9 wherein each of the hanging openings has a central region and two opposing end regions each having a radius of curvature, the radius of curvature of the central region being greater than the radius of curvature of each of the two opposing end regions.

11. The flexible bag of claim 1 wherein the spout assembly includes a base flange and a body extending from the base flange.

12. The flexible bag of claim 11 wherein each of the multiple plies comprises one of a co-extrusion and a laminate.

13. A flexible bag comprising:

an outer panel assembly comprising a first panel and a second panel positioned in an overlaying orientation;

a cavity sealing assembly comprising:

a first side seal and a second side seal opposing the first side seal;

a top cavity seal spanning between the first and second side seals;

the first side seal further including a first extension region extending away from the top cavity seal and the second side seal further including a second extension region extending away from the top cavity seal, the first extension region positioned proximate the first side seal and the second extension region positioned proximate the second side seal; and a bottom cavity seal spanning between the first and second side seals, spaced apart from the top cavity seal a distance, to, in turn, define a cavity for a flowable material;

a spout assembly attached to the first panel, the spout providing fluid communication with the cavity;

a handle area outside of the cavity, the handle area including:

a top handle seal spaced apart from the top cavity seal and the first and second extension regions, the first extension region in cooperation with the top handle seal defines a first side opening slot having a width, and, the second extension region in cooperation with the top handle seal defines a second side opening slot having a width, wherein a width in a region between the first side opening slot and the second side opening slot is larger than the respective width of each of the first and second side opening slots;

at least one hanging opening extending through the first panel and the second panel positioned between the top cavity seal and the top handle seal, and spaced apart from any seal, wherein the at least one hanging opening comprises an upwardly concave configuration positioned closer to the top cavity seal than the respective ends of the first and second extension regions.

14. The flexible bag of claim 13 further comprising a bottom handle seal which is spaced apart from the top cavity seal and which intersects each of the first and second extension regions.

15. The flexible bag of claim 14 wherein the top cavity seal, the bottom handle seal and the top handle seal are substantially parallel to each other, and the extension regions are substantially perpendicular thereto.

16. The flexible bag of claim 15 wherein the bottom cavity seal is substantially parallel to the top cavity seal.

* * * * *